US005413463A

United States Patent [19]

Chiu et al.

[11] Patent Number: 5,413,463

[45] Date of Patent: May 9, 1995

[54] TURBULATED COOLING PASSAGES IN GAS TURBINE BUCKETS

[75] Inventors: Paul Chiu, Scotia; Nesim Abuaf, Schenectady, both of N.Y.

[73] Assignee: General Electric Company, Schenectady, N.Y.

[21] Appl. No.: 814,607

[22] Filed: Dec. 30, 1991

[51] Int. Cl.[6] ..... F01D 5/08

[52] U.S. Cl. ..... 416/95; 416/96 R

[58] Field of Search ..... 416/90 R, 95, 96 R, 416/97 R; 415/115, 116; 29/889.721

[56] References Cited

U.S. PATENT DOCUMENTS

| | | | |
|---|---|---|---|
| 2,423,700 | 7/1947 | Hardy | 416/96 |
| 2,737,366 | 3/1956 | Ledinegg | 416/96 |
| 2,833,514 | 5/1958 | Rainbow et al. | 253/39.1 |
| 3,329,596 | 7/1967 | Abt et al. | 416/96 |
| 3,628,885 | 12/1971 | Sidenstick et al. | 416/97 |
| 3,696,014 | 10/1972 | Goodard et al. | 204/143 |
| 4,256,555 | 3/1981 | Wilson et al. | 204/129 |
| 4,278,400 | 7/1981 | Yamarik et al. | 416/97 R |
| 4,416,585 | 11/1983 | Abdel-Messeh | 416/97 |
| 4,629,397 | 12/1986 | Schweitzer | 416/96 |
| 4,772,367 | 9/1988 | Menzel et al. | 204/129 |
| 4,818,178 | 4/1989 | Sibbertsen | 415/115 |
| 4,859,141 | 8/1989 | Maisch et al. | 415/115 |
| 5,002,460 | 3/1991 | Lee et al. | 416/96 |

FOREIGN PATENT DOCUMENTS

| | | | |
|---|---|---|---|
| 0207799 | 1/1987 | European Pat. Off. . | |
| 2165499 | 8/1973 | France . | |
| 2552817 | 4/1985 | France . | |
| 2143085 | 8/1971 | Germany . | |
| 0031209 | 3/1977 | Japan | 416/96 A |
| 0113905 | 7/1982 | Japan | 416/95 |

*Primary Examiner*—Edward K. Look
*Assistant Examiner*—Mark Sgantzos
*Attorney, Agent, or Firm*—Nixon & Vanderhye

[57] ABSTRACT

A turbine blade includes a plurality of cooling passages each having a turbulated section of the passage preferentially located along the portion of the turbine blade subjected to the highest temperature. Thus, turbulent air flow is provided in intermediate sections of the blade to enhance the heat exchange relation with the metal of the blade. The bores of the cooling passages adjacent the tip and root portions are smooth and provide adequate cooling in those sections at a lower heat exchange relationship. The cooling passage bores are formed by an electrochemical machining process using an elongated electrode with a chemical electrolyte for forming enlarged cavities within the blade.

7 Claims, 2 Drawing Sheets

TURBULATED COOLING PASSAGES IN GAS TURBINE BUCKETS

BACKGROUND AND SUMMARY

The present invention relates to gas turbines in general and particular to turbine blades or buckets having cooling passages within the blades for efficient heat exchange with, and cooling of, the blades.

It is customary in turbines to provide internal cooling passages in the blades or buckets of turbine rotors and it has been recognized that the various stages of the turbine rotors require more or less cooling, depending upon the specific location of the stage in the turbine. The first stage turbine buckets usually require, among the various rotor stages, the highest degree of cooling because those turbine blades are the blades exposed immediately to the hot gases of combustion flowing from the combustors. It has also been recognized that the temperature profile across each turbine blade peaks along an intermediate portion of the blade, i.e., in a stagnation or pitch area., and that the temperatures adjacent the root and tip portions of the blades are somewhat lower than the temperatures along the intermediate portion.

Typically, a plurality of cooling passages are provided within the turbine blades extending from the blade root portion to the tip portion. Cooling air from one of the stages of the compressor is conventionally supplied to these passages to cool the blades. Certain turbine blade designs employ turbulence promoters throughout the entire length of these passages to enhance the heat transfer mechanism between the metal of the blades and the flow of cooling air through these passages. This enhancement of the heat transfer coefficient between the blade material and the cooling air occurs by breaking down the boundary layer of air flowing along the internal passages and hence reducing the resistance to heat transfer caused by the thickness of the boundary layer. Consequently, the turbulence promoters separate the flow of cooling air from the internal wall of the blade, rendering it turbulent and hence mix the cool incoming air with the air near the wall to improve the heat transfer relation. In short, the laminar flow normally associated with smooth bore passages in the turbine blade is converted to a turbulent flow to enhance heat transfer.

A problem with the use of turbulence promoters, however, is that the enhancement in heat transfer is accompanied by an increase in the flow resistance and hence an increase in frictional pressure drop in the cooling passage. The increase in pressure drop, of course, means a conversion of the energy into frictional losses which, in turn, decrease the efficiency of the machine. With turbulence promoters extending the full length of the cooling passages, the pressure drop is increased, resulting in friction losses and cooling in regions along the blade where cooling is not necessary or cooling to the extent provided in sections containing turbulence promoters is not required. Because the local cooling requirements along the length of the turbine blades from the root to the tip portions depend on the local external gas temperatures and heat transfer coefficients, the use of turbulence promoters along the entire length of the cooling passages for the blade generates a heat transfer enhancement in needed, as well as unneeded, portions of the turbine. This creates unnecessary and large pressure losses.

Moreover, the formation of turbulence promoters in the internal cooling passages of a turbine blade is a costly, time-consuming operation. One method employed to form the passages in a turbine blade is known as electrochemical machining (ECM). In that method, the turbine blade is first cast and then drilled from tip to root, using an elongated, thin electrode having a central, passage for flowing a chemical electrolyte. Upon energization of the electrode and application of the electrode tip to the blade tip, the electrode removes the metal to penetrate the tip and form the passage. By changing the residence time in the passage, it is possible to remove additional or lesser quantities of metal, as necessary.

According to the present invention, the cooling passages of a turbine blade are provided with turbulence promoters at preferential areas along the length of the airfoil from the root to the tip portions, depending upon the local cooling requirements along the blade. Because the temperature profile of a turbine blade is such that an intermediate region between the root and tip portions is the hottest portion of the blade (the root and tip portions being somewhat cooler), the turbulence promoters are preferentially located in this intermediate region of the turbine blade, while the passages through the root and tip portions of the blade remain essentially smooth-bore. It has been found according to the present invention that the increased turbulence in the hottest portion of the blade increases the heat transfer coefficient sufficiently to maintain the material of the blade in that region below its melting temperature. Also, it has been found that the flowing of cooling fluid, e.g., air, in the root and tip portions of the blade is sufficient to cool the blade in those areas to the required temperature without incurring the penalty of an additional pressure drop caused by promoting turbulence in those areas. Consequently, the length of the intermediate portion of the blade and the geometry of the turbulated section is selected in accordance with local cooling requirements along the blade length necessary to maintain the metal wall temperatures within design limits.

In a preferred embodiment according to the present invention, there is provided a blade for a turbine comprising a blade body having a cross-section generally airfoil in shape, with root and tip portions adjacent opposite ends and a portion intermediate the root and tip portions. A plurality of cooling passages extend within the blade body through the root and tip portions and the intermediate portion for conducting cooling fluid along the blade body in heat transfer relation therewith, at least one of the cooling passages having a series of turbulence promoters formed along the intermediate portion to provide a turbulent flow of cooling fluid through the intermediate portion and enhanced heat transfer between the blade body and the cooling fluid flowing through the one passage. The portions of one passage pass; through the root and tip portions having smooth bores to provide substantially non-turbulent flow of cooling fluid through the root and tip portions of one passage.

In a further preferred embodiment according to the present invention, there is provided a rotor blade for a turbine comprising a blade body having a cross-section generally airfoil in shape, with root and tip portions adjacent opposite ends and a portion intermediate the root and tip portions. A plurality of cooling passages extend within the blade body through the root and tip portions and the intermediate portion for conducting cooling fluid along the blade body in heat transfer relation therewith, at least one of the cooling passages having a series of turbulence promoters formed along the intermediate portion to provide a turbulent flow of fluid through the intermediate portion and enhanced heat transfer between the blade body and the cooling fluid flowing through one passage. The turbulence promoters are formed solely along the intermediate section commencing at about 20% of the length of the blade from the root end of the blade and terminating at about 20% of the length of the blade from the tip end of the blade.

In a further preferred embodiment according to the present invention, there is provided a method of forming cooling passages in a turbine blade by an electrochemical machining process having an elongated electrode for penetrating the metal of the blade, comprising the steps of (a) applying the electrode to one end of the blade to penetrate the blade end to form a first cooling passage having a relatively smooth bore, (b) subsequently successively slowing and increasing the rate of penetration of the electrode into the blade whereby the residence time of the tip of the electrode in the blade is successively altered to form successively larger and smaller diameter bore portions at successive locations along the length of the blade and (c) subsequent to step (b), advancing the electrode at a substantially constant rate of penetration to provide a relatively smooth bore portion of cooling passage adjacent the opposite end of the turbine blade.

It is a primary object of the present invention to provide a turbine blade having preferentially located turbulence promoters for enhancing the heat transfer in regions of the blades subjected to the higher temperatures in use whereby pressure losses due to cooling requirements are reduced and efficiency increased. It is a further object of the present invention to provide an improved method of forming cooling passages in turbine blades.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment: of the invention, an example of which is illustrated in the accompanying drawings.

Figure 1:
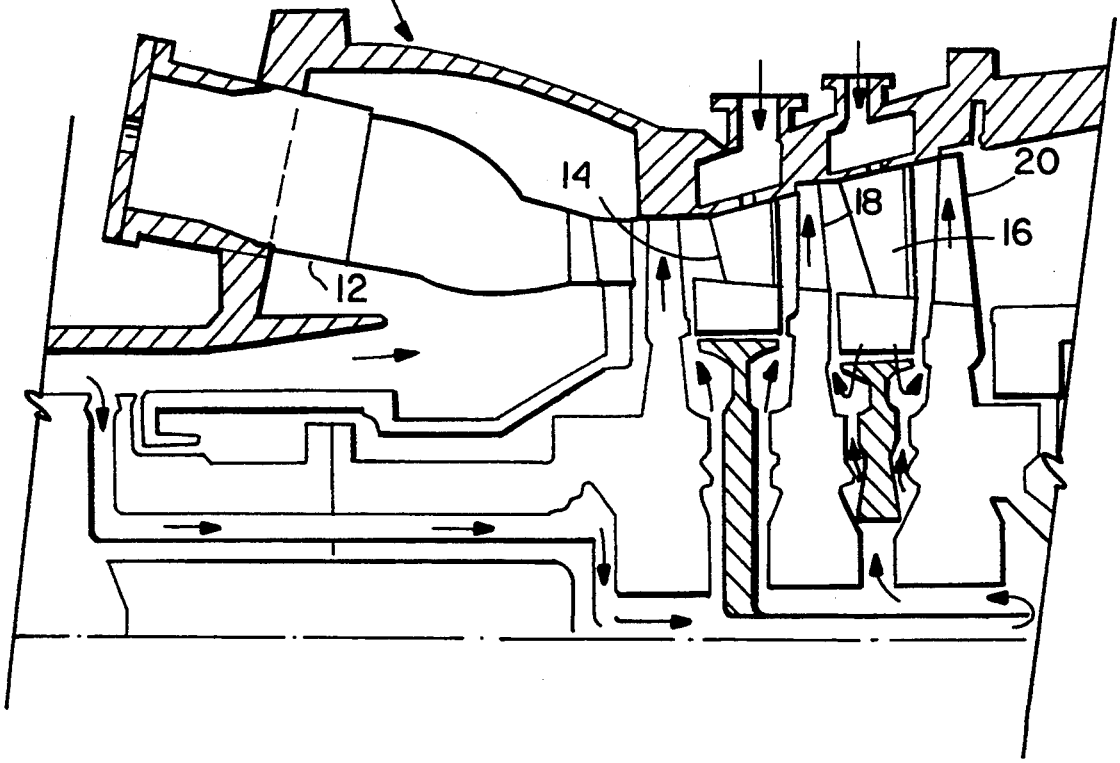
FIG. 1 is a fragmentary cross-sectional view through a portion of a gas turbine illustrating a combustor and first and second nozzle and turbine stages.
Figure 3:
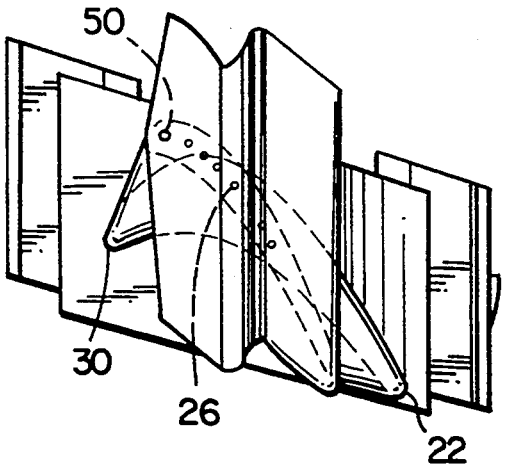
FIG. 3 is an end elevational view of the turbine blade illustrated in FIG. 2 as viewed from the tip looking radially inwardly along the blade.

Referring now to FIG. 1, there is illustrated a gas turbine, generally designated 10, having a combustor 12 for supplying hot gases of combustion through the turbine staging. The turbine staging includes first and second nozzle stages 14 and 16, respectively, as well as first and second turbine stages 18 and 20, respectively. Except as hereinafter specified, the turbine is of conventional construction wherein compressor extraction air is supplied about the rotor wheels and through suitable inlets for passage through cooling passages in the turbine blades.

Figure 2:
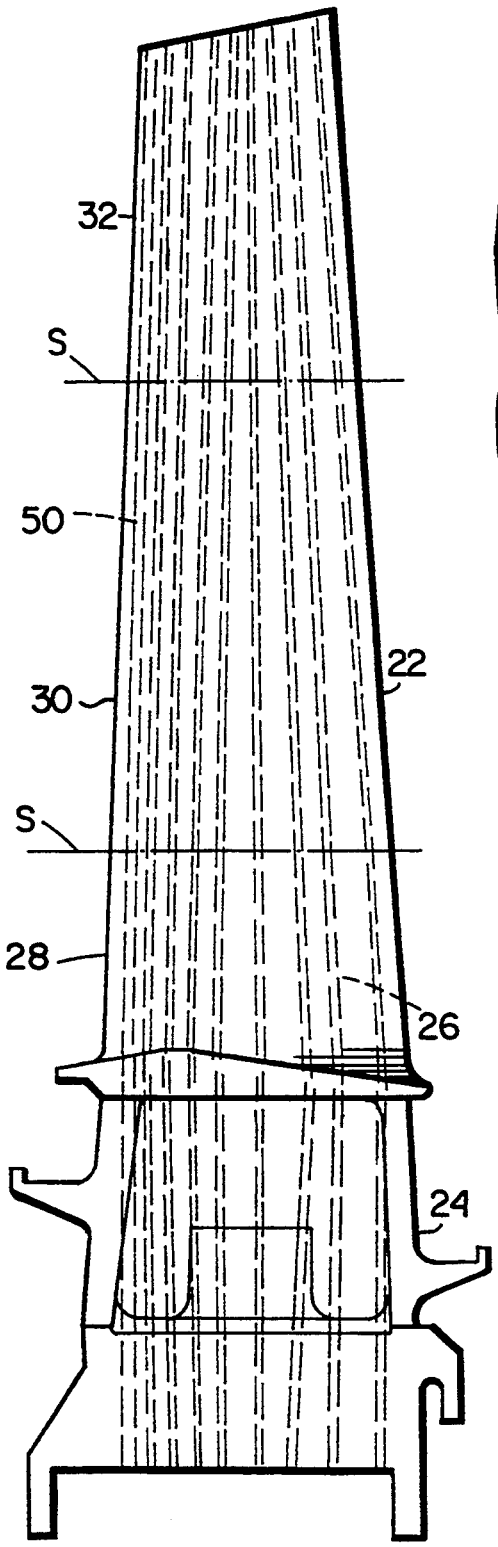
FIG. 2 is an enlarged side elevational view of a turbine blade illustrating cooling passages through the blade according to the present invention.

Referring now to FIG. 2, there is illustrated a turbine blade 22 mounted on a pedestal 24 and having a plurality of cooling passages 26 extending through the blade over its entire length, including from a root portion 28 through an intermediate portion 30 and a tip portion 32. The cooling passages exit at the tip of the blade. The cooling passages 26 conduct cooling fluid, e.g., air, from inlets in communication with the compressor extraction air, throughout their entire length for purposes of cooling the material, e.g., metal, of the blade 22. For purposes of illustration, the intermediate section 30 of the blade 22 is defined between the lines designated S and S. Those lines approximate the location of the stagnation or pitch portion of the blade and which portion obtains the highest temperature when subjected to the hot gases of combustion as those gases flow through the stages of the turbine. The lines, of course, do not represent dramatic or step changes in the temperature. Rather, they delineate areas of gradual changes in temperature between the hotter intermediate portion and the relatively cooler root and tip portions. That is to say, the temperature profile along the length of the blade approximates a gradual half-sine wave rather than sharply delineated temperature gradients.

Figure 4:
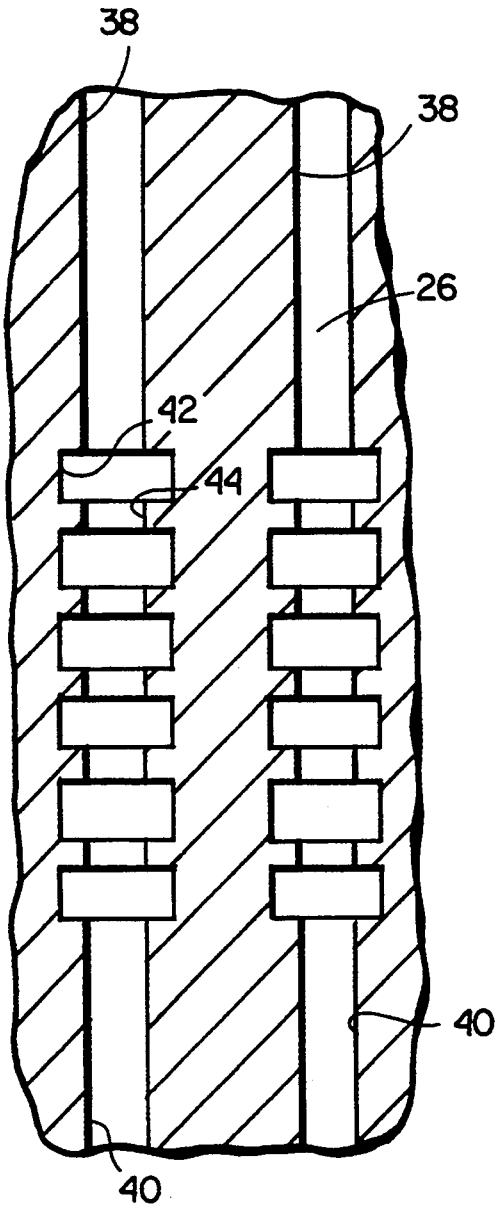
FIG. 4 is an enlarged fragmentary cross-sectional view illustrating a pair of cooling passages with a turbulated section and smooth-bore sections corresponding to the intermediate section and root and tip portions of the blade, respectively.

Referring to FIG. 4, it will be seen that the passages 26 have relatively smooth bores 38 and 40 extending through tip and root portions 28 and 32, respectively, whereas the intermediate section 30 has a series of axially spaced recesses with projecting ribs therebetween. That is, the wall portions of the passages 26 along the intermediate section 30 are designed to promote turbulent flow by the formation of turbulence promoters 42 and 44 within the intermediate section 30. The turbulence promoters 42 comprise the annular recesses, while the promoters 44 comprise the annular ribs between the recesses 42. Rib roughened passage geometries including promoter rib height, spacing and smooth tube diameters tested for this application are presented in Table 1.

TABLE 1

| Diameter (Inches) | Rib Height (Inches) | Rib Spacing (Inches) |
|---|---|---|
| 0.097 | 0.010 | 0.100 |
| 0.107 | 0.015 | 0.150 |
| 0.115 | 0.010 | 0.100 |
| 0.125 | 0.015 | 0.150 |
| 0.136 | 0.010 | 0.100 |
| 0.146 | 0.015 | 0.150 |
| 0.228 | 0.015 | 0.150 |
| 0.238 | 0.020 | 0.200 |

As a consequence of this construction, the convective cooling air first flows through the smooth bore portion of the passage 26 adjacent root portion 28 in a substantially laminar flow configuration. Because the metal of the root portion of the blade is cooler than the metal of the intermediate portion of the blade under typical operating conditions, the laminar flow of cooling fluid has sufficient heat transfer coefficient to adequately cool that portion of the blade within design limits. Similarly, the cooling air flowing through the smooth bore portion 38 of the passages 26 adjacent the tip portion 32 provides a laminar flow in sufficient heat transfer relation with the metal of the blade to maintain the temperature of the tip portion within design limits. The intermediate section 30 which corresponds to the hottest portion of the blade has a generally turbulent cooling flow therethrough caused by the alternating recesses 42 and ribs 44. This turbulent flow breaks up the boundary layer of the cooling air along the walls of the passage and reduces the resistance to efficient heat exchange relation between the cooling air and the metal of the blade. As a result, the convective cooling passages of the blades are preferentially cooled in accordance with the anticipated temperatures of the metal in the various regions along the blade.

Additionally, the leading edge of the turbine blade and particularly along the intermediate section thereof, comprises the hottest region along the blade surface in the axial direction of gas flow. To provide more effective cooling in that area, the forwardmost or leading cooling passage 50 adjacent the leading edge of the blade has a large diameter in comparison with the diameter of the cooling passages located more toward the trailing edge of the blade. Thus, greater quantities of cooling air are disposed in the leading air passage 50 to enhance the heat exchange relation between the cooling air and the metal adjacent the leading edge. Of course, the turbulated intermediate section of the leading edge passage is likewise enlarged in diametrical cross-section whereby the combined effects of the turbulent flow in that section and the enlarged cross-sectional area enhance the cooling effect on the hottest portion of the blade.

In order to form passages in the intermediate section, an electrochemical machining process is employed. In that process, an electrode having a central core for passing chemical electrolyte is applied to the tip of the cast metal. Upon energization of the electrode, the electrode tip and flowing electrolyte penetrate the tip of the blade to form a smooth-bore initial passage. When the intermediate section of the blade is reached, the rate of penetration may be slowed to form a larger diameter passage. That is to say, the residence time of the tip of the electrode along the bore hole determines the diameter of the hole to be formed. Hence the stepped recesses and ribs may be formed by alternately slowing and increasing the rate of penetration, respectively, of the electrode tip in the region of the blade where the turbulated passages are to be formed. After forming the turbulence promoters in the intermediate section of the blade, the electrode continues its penetration substantially at a constant rate to form the final smooth-bore portion.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blade for a turbine comprising:

a blade body having a cross-section generally airfoil in shape, with root and tip portions adjacent opposite ends and a portion intermediate said root and tip portions;

a plurality of cooling passages extending within said blade body through said root and tip portions and said intermediate portion for conducting cooling fluid along said blade body in heat transfer relation therewith, at least one of said cooling passages having a series of turbulence promoters formed along said intermediate portion to provide a turbulent flow of cooling fluid through said intermediate portion and enhanced heat transfer between the blade body and the cooling fluid flowing through said one passage;

said turbulence promoters including generally annular recesses about said one passage and axially spaced one from the other along said one passage to define generally annular radially inwardly projecting ribs axially spaced one from the other along said one passage;

the portions of said one passage passing through said root and tip portions having smooth bores to provide substantially non-turbulent flow of cooling fluid through said root and tip portions of said one passage.

2. A blade according to claim 1 wherein said turbulence promoters are formed along said intermediate section commencing at about 20% of the length of the blade from the root end of the blade and terminating at about 20% of the length of the blade from the tip end of the blade.

3. A blade according to claim 1 wherein said blade body in use is subjected to higher temperatures along said intermediate portion than compared with said root and tip portions, said turbulence promoters being disposed along said intermediate portion for cooling the portion of the blade subjected to the higher temperatures.

4. A blade according to claim 1 wherein said annular ribs have a diameter substantially corresponding to the diameter of the smooth bores of said one passage passing through said root and tip portions and the diameters of said recesses are larger than the diameters of said bore.

5. A blade according to claim 1 wherein each of said plurality of said cooling passages has a series of turbulence promoters formed along said intermediate portion thereof to provide enhanced heat transfer between the blade body and the cooling fluid flowing through the intermediate passage portion, the turbulence promoters of each of said passages including generally annular recesses axially spaced one from the other therealong to define generally annular radially inwardly projecting ribs about the passage axially spaced one from the other, the portions of said passages passing through said root and tip portions thereof having smooth bores to provide non-turbulent flow of cooling fluid through said root and tip portions of said passages.

6. A rotor blade for a turbine compromising:

a blade body having a cross-section generally airfoil in shape, with root and tip portions adjacent opposite ends and a portion intermediate said root and tip portions;

a plurality of cooling passages extending within said blade body through said root and tip portions and said intermediate portion for conducting cooling fluid along said blade body in heat transfer relation therewith, at least one of said cooling passages having a series of turbulence promoters formed along said intermediate portion to provide a turbulent flow of fluid through said intermediate portion and enhanced heat transfer between the blade body and the cooling fluid flowing through said one passage;

said turbulence promoters including generally annular recesses about said one passage and axially spaced one from the other along said one passage to define generally annular radially inwardly projecting ribs axially spaced one from the other along said one passage;

said turbulence promoters being formed solely along said intermediate section commencing at about 20% of the length of the blade from the root end of the blade and terminating at about 20% of the length of the blade from the tip end of the blade.

7. A rotor blade according to claim 6 wherein said annular ribs have a diameter substantially corresponding to the diameter of the smooth bores of said one passage passing through said root and tip portions and the diameters of said recesses are larger than the diameters of said bore.

* * * * *